US009399197B2

(12) United States Patent
Graham

(10) Patent No.: US 9,399,197 B2
(45) Date of Patent: Jul. 26, 2016

(54) AERATION METHOD

(71) Applicant: Craig William Graham, Anacortes, WA (US)

(72) Inventor: Craig William Graham, Anacortes, WA (US)

(73) Assignee: AHNTRA LLC, Anacortes, WA (US)

( * ) Notice: Subject to any disclaimer, the term of this patent is extended or adjusted under 35 U.S.C. 154(b) by 135 days.

(21) Appl. No.: 14/202,035

(22) Filed: Mar. 10, 2014

(65) Prior Publication Data

US 2014/0252662 A1 Sep. 11, 2014

Related U.S. Application Data

(60) Provisional application No. 61/776,056, filed on Mar. 11, 2013.

(51) Int. Cl.
*B01F 3/04* (2006.01)
*B01F 5/04* (2006.01)

(52) U.S. Cl.
CPC ..... *B01F 5/0428* (2013.01); *B01F 3/0446* (2013.01); *B01F 3/04794* (2013.01); *B01F 2215/0072* (2013.01)

(58) Field of Classification Search
CPC .... B01F 3/04; B01F 3/04007; B01F 3/04099; B01F 3/0446; B01F 3/04787; B01F 3/04794
USPC ..... 261/78.2, DIG. 75; 99/323.1
See application file for complete search history.

(56) References Cited

U.S. PATENT DOCUMENTS

2015/0174537 A1* 6/2015 Foldesi, Jr. ..... B01F 3/04787 261/79.2

* cited by examiner

*Primary Examiner* — Robert A Hopkins

(57) ABSTRACT

This invention relates to an aerator that resides fully in the neck of a bottle or other liquid vessel. Through differential pressure, created through a venturi, the aerator mixes air with the fluid contained in the bottle. More specifically, the aerator can be used to mix air with wine as the bottle is inverted thus essentially instantly decanting the wine.

19 Claims, 11 Drawing Sheets

AERATION METHOD

CROSS-REFERENCE TO RELATED APPLICATION

This application claims benefit of U.S. Provisional Application No. 61/776,056 filed Mar. 11, 2013

REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

Many types of wine such as Merlot, Cabernet, etc, have noticeably improved taste after they have been allowed to interact with fresh air. This can be accomplished through many techniques. A wine bottle can be allowed to sit for an extended period of time after it has been opened. Or wine can be swirled in a glass to accelerate the introduction of air to the wine. Wine can also be poured through a device specifically designed to mix air with the wine, such a U.S. Pat. No. 6,568,660. Also, application Ser. No. 12/893,057 pub. No. US2012/0074092A1 discloses an aerator fully enclosed in the neck of a bottle.

The objective of this invention is to add as much air as possible to wine as quickly as possible as it is being poured from its storage container (for the preferred embodiment the container is a glass bottle of wine with a screw cap) into a wine glass as quick as possible and with enough air interaction to make the wine taste as good as possible.

SUMMARY OF THE INVENTION

The objective of this invention, and the preferred embodiment, is to injection mold an aerator, with an integrated venturi, that is small enough to fit into the neck of a twist top bottle of wine. The aerator would then have a vent tube pressed into it. It also has an air channel integrated into it that allows air to flow to the venturi throat from the exposed face without interacting with the wine in the bottle before it get there. The aerator is pressed into the neck of the bottle, tube end first. Those skilled in the art would realize that in some embodiments the vent tube could also be integrated into the mold for the aerator. When wine is poured from the bottle, the wine goes through the venturi where it is engulfed in air due to the physics of the venturi. The vent tube allows for high flow rate as the wine is dispensed. The aerator seals against the inside frustoconical surface of the wine bottle, this forces the wine through the aerator as opposed to around it.

Also one skilled in the art would realize that in some embodiments there could be multiple tubes, a method for attaching the vent tube in the preferred embodiment consists of a press fit. Due to limitations in injection molding, it is very difficult to produce an orifice for air entering the venturi throat, without also creating an orifice in the outer surface of the aerator, which would then become a leak path leading to premature interaction of the venturi air with the wine. In the preferred embodiment, this opening on the outside of the aerator is plugged with the vent tube. More specifically the one end of the vent tube is cut at an angle. This end is inserted into the aerator. The longer portion of the vent tube is then oriented so that it blocks the unwanted outside hole while leaving the inside hole, which feeds the venturi, open. In some embodiments, this unwanted outer opening (for example, which is created from the core pin that also creates the venturi air intake during molding, as previously described) is plugged with a tapered plug that is pressed into the outer hole. In some embodiments the vent tube could have an opening in its wall, near one of its ends, or a slot that starts at the end and moves axially down the wall of the tube. In these embodiments the opening near the end of the tube would be oriented so that it is concentric or partially aligned with the venturi throat air hole, but blocks the unwanted hole on the outer surface of the aerator.

In other embodiments, this unwanted opening on the outside of the aerator for example could also be closed with a boss that is molded to the outside surface of the aerator and then distorts as the aerator is inserted into the bottle to an extent that it occludes the unwanted opening. The preferred embodiment also contains a chamfered lip that serves as a stop against the chamfer on the inside edge of the end of the neck of the bottle. This lip to bottle contact prevents the aerator from being driven too deep into the bottle.

In the preferred embodiment the angled end of the vent tube is pushed into a hole in the surface that is facing the bottom of the bottle. The fit between the tube and the hole keeps the tube secure. This tube then vents the back of the bottle to atmospheric pressure. Without a vent tube the bottom of the bottle would be under a partial vacuum, which would retard full flow through the aerator. In the preferred embodiment the angled vent tube allows the wine to pour at a high rate.

The length of the tube is restricted by the depth of the bottle. In the preferred embodiment there should be a slight gap between the chamfered vent tube and the bottom of the bottle. This gap allows for flow of air and keeps the bottom of the bottle from occluding the tube. A person skilled in the art will realize that the vent tube could be shorter. In the preferred embodiment the diameter of the vent tube is the same as a large drinking straw, although in some embodiments it could be smaller or larger.

As with any venturi, as described in U.S. Pat. No. 6,568,660, the venturi air intake is nearly normal to the venturi throat in the preferred embodiment. The high velocity fluid passing through the smaller diameter channel in the venturi throat causes low pressure, which allows the introduced higher pressure air at the venturi air intake to be forced into the fluid, wine in the preferred embodiment, thus aerating the wine in the preferred embodiment. Those skilled in the art realize that other liquids could be aerated in this same manner.

The venturi air intake passages originate from the outer exposed face of the aerator (when installed in a bottle), runs parallel to the centerline of the bottle, makes a 90 degree turn and ends up nearly normal to the venturi throat, at the axially center to the throat region. To maintain good air flow, this passage needs to be sealed from the wine in the bottle and is therefore difficult to manufacture without secondary operations and subsequent assembly of sealing members such as plugs for example. The vast majority of wine bottles have frustoconical shaped necks, which compounds the problem of sealing the unwanted opening. For example if a cylindrical object is inserted into a frustoconical shaped neck, the inner wall of the bottle will diverge from the cylindrical surface. This divergence causes a gap which would create a leak path if the cylinder were an aerator. This disclosed invention allows for sealing the venturi air path to the inside surface of a frustoconical shaped bottle neck.

Prior art discloses multiple half round seal redundant seal ribs on the aerator to seal against the inside surface of the bottle to guarantee that fluid does not leak out and air does not enter in. The preferred embodiment discloses alternate seal rib shapes to account for bottle inconsistencies and a frustoconical neck.

As stated, the inside diameter of the frustoconical shaped wine bottle necks are not consistent. This invention provides for seals with adequate compliance to allow for sealing to a wide range of inner neck diameters, which is in the same location as a cork in bottle would be.

The aerator in the preferred embodiment can also be installed during the bottling process or after the bottle has been opened.

Furthermore, due to the fluid dynamics of the fluid dispensing process and the related orientation of the orifices in the aerator, the aerator must be oriented relative to gravity in order to achieve the best aeration. This Aerator is configured to make it obvious to the person pouring the wine as to how it needs to be oriented.

DETAILED DESCRIPTION

Figure 1:
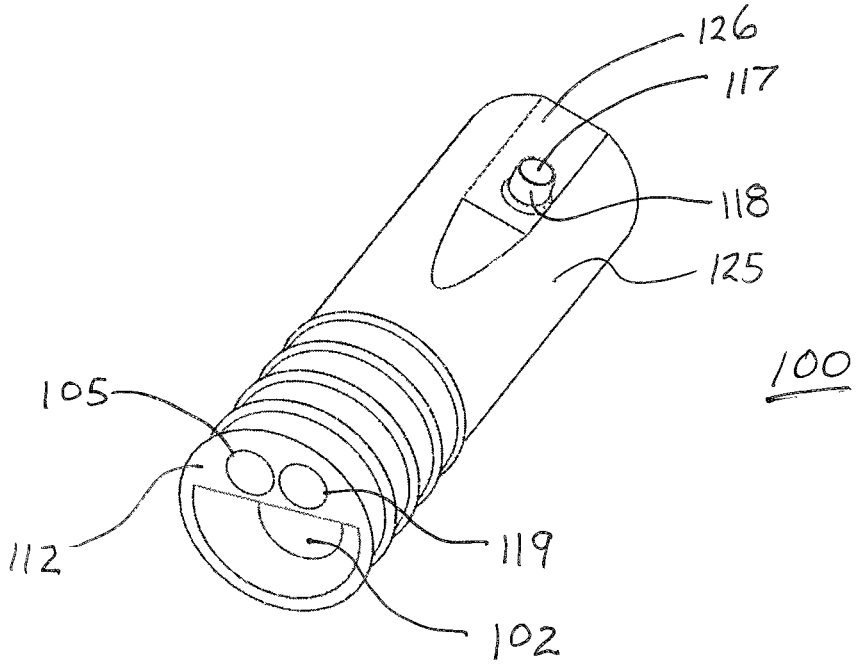
FIG. 1 is an isometric front oriented view of the preferred embodiment

Referring to FIG. 1 Aerator 100, which is used to aerate wine, is shown with exterior face 112, cylindrical face 125. The aerator 100 has a cylindrical face 125 which is small enough in diameter to fit into the neck of a wine bottle. During operation air is sucked into bottle vent intake 105 and venturi air intake port 119. At the same time aerated wine flows out of venturi exhaust 102. In order for this to process to function correctly opening 117 (which is a byproduct of the injection molding process) would be sealed. In the preferred embodiment the air intake seal 118 and recess 126 would be produced during manufacturing and would be used as a seal to close opening 117. In the preferred embodiment aerator 100 is molded out of PE plastic, but one skilled in the art would realize that Aerator 100 in some embodiments could be made from other plastic such as but not limited to PET, PCP, HDPE, LDPE, PP, PVC, PEEK, PFA, POM, FEP, PPS, FEP in some embodiments Aerator 100 could also be machined or cast from materials such as aluminum or stainless steel or plastic such as PET, PE, PCP, HDPE, LDPE, PP, PVC, PEEK, PFA, POM, FEP, PPS, FEP. Aerator 100 could also be made from ceramic, glass, an elastomer.

Figure 2:
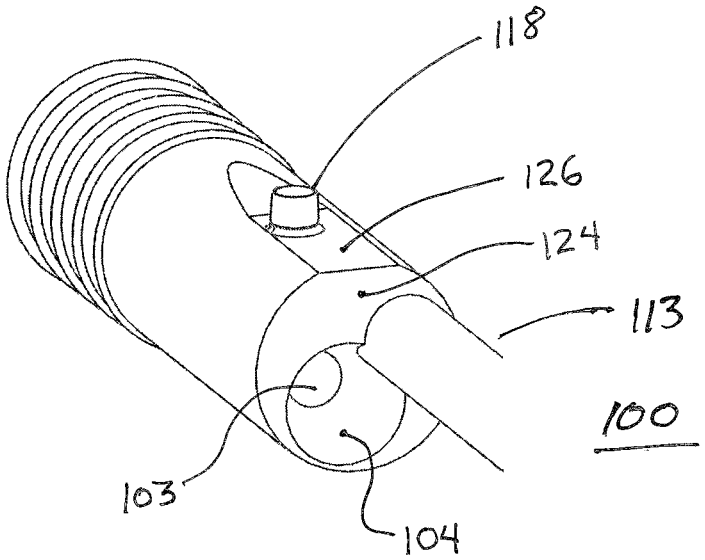
FIG. 2 is an isometric rear oriented view of the preferred embodiment

Referring to FIG. 2 the rear of Aerator 100 is shown, rear face 124 has bottle vent tube 113 inserted into it and is held into the aerator with friction in the preferred embodiment, although a person skilled in the art would realize that bottle vent tube 113 could be fixed to aerator 100 with adhesive or welded or heat staked or an integral part and produced during injection molding of aerator 100 during manufacturing. In the preferred embodiment bottle vent tube 113 is co-linear with and an open airway with bottle vent intake 105 (not shown). Also in the preferred embodiment bottle vent tube 113 is extruded out of PE plastic, but one skilled in the art would realize that it could also be made from PET, PCP, HDPE, LDPE, PP, PVC, PEEK, PFA, POM, FEP, PPS, FEP. In some embodiments it could also be molded or drawn or made from SS, copper alloy, or nickel alloy tubing. Venturi intake 104 is also shown in FIG. 2; in operation wine would flow into Venturi intake 103, then through venturi throat 103, then out of aerator 100 on the far side of aerator 100 as shown in FIG. 2.

Figures 3A, 3B:
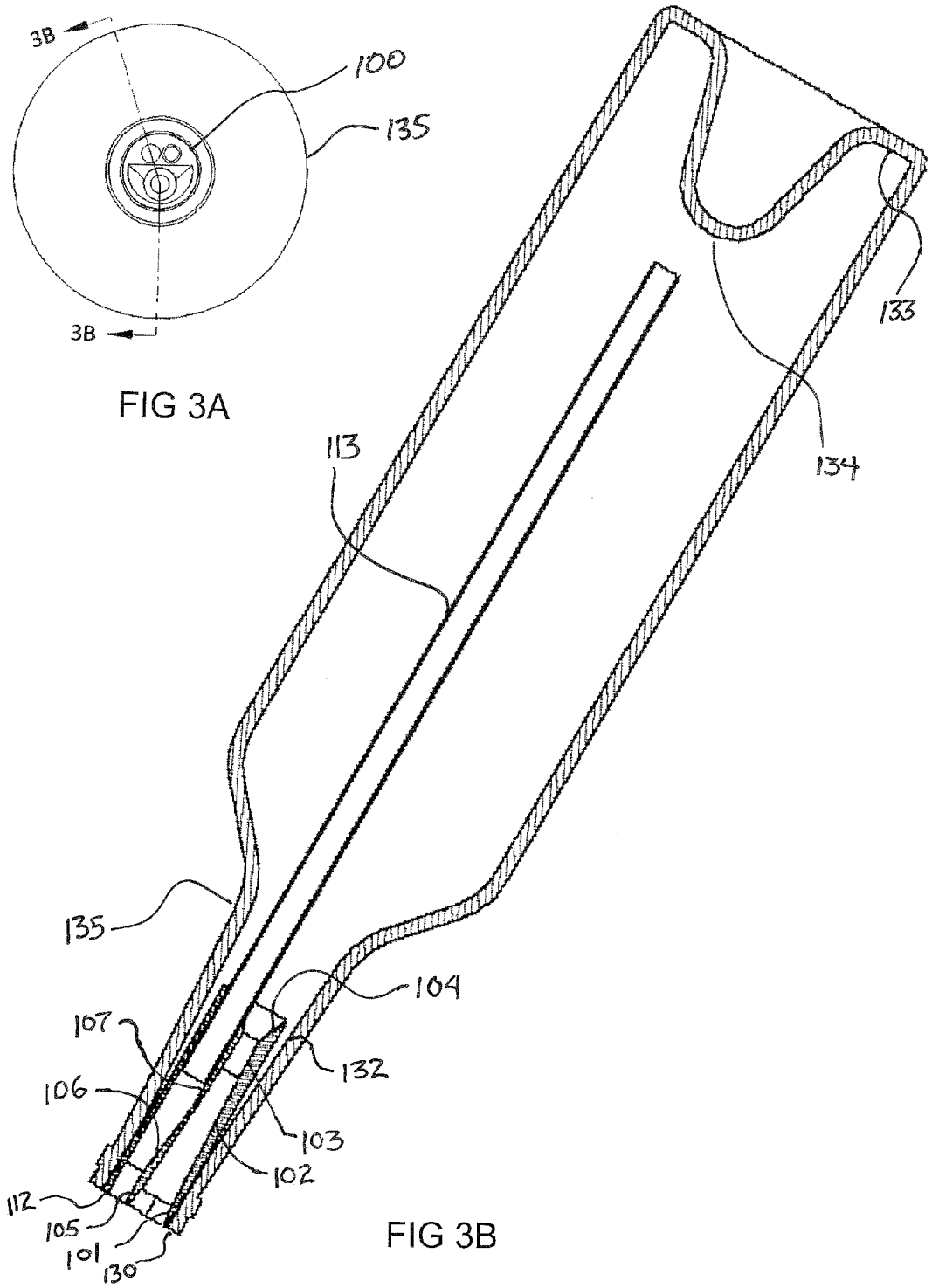
FIG. 3A is a front view of the preferred embodiment
FIG. 3B is a section view of the preferred embodiment

FIG. 3A is an end view of bottle 135 shown with Aerator 100 installed. Section line A-A is the defining cross-section cut for FIG. 3B Referring to FIG. 3B, which is a section view originating from section line A-A shown in FIG. 3A, bottle vent tube 113 is shown inserted into aerator 100 and is in contact with surface 107. This surface contact produces pressures between bottle vent tube 113 and surface 107 that are high enough to allow friction between the two surfaces to keep the bottle vent tube 113 secure. In some embodiments if bottle vent tube 113 is inserted deeper into aerator 100, the end of bottle vent tube 113 will hit tapered 106, which will cause increasing higher contact pressures, which will in turn increase friction between the surfaces, thus further securing bottle vent tube 113 in aerator 100. When bottle 135 is tipped for pouring, bottle vent tube 113 allows the bottle bottom 133 to be vented to atmospheric pressure (concurrently, wine travels through venturi throat 103 due to gravitational force). One skilled in the art would realize that other liquids could also be aerated in this same manner.

Still referring to FIG. 3B, in the preferred embodiment, air travels from the exterior face 112 through the bottle vent tube 105, through the tapered surface 106 and through the bottle vent tube 113 to the bottle bottom 133. This flow of air prevents a pressure vacuum from forming in the bottom of the bottle 133 (which would retard the flow of fluid and reduce the aeration performance through venturi throat 103) as wine pours from the bottle 135. This method of venting in the preferred embodiment allows the full contents of the bottle to be dispensed with the full aeration action at venturi throat 103. In some embodiment up to 95% of the wine can be fully aerated. This will be discussed in greater detail later in the specification.

Figure 4A:
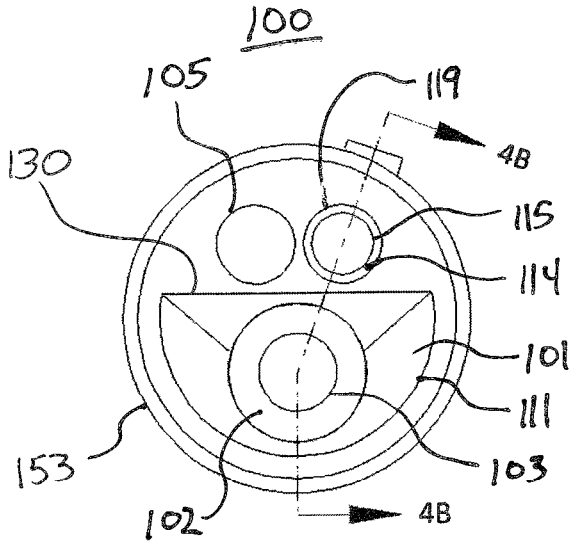
FIG. 4A is a front view of the preferred embodiment
Figure 4B:
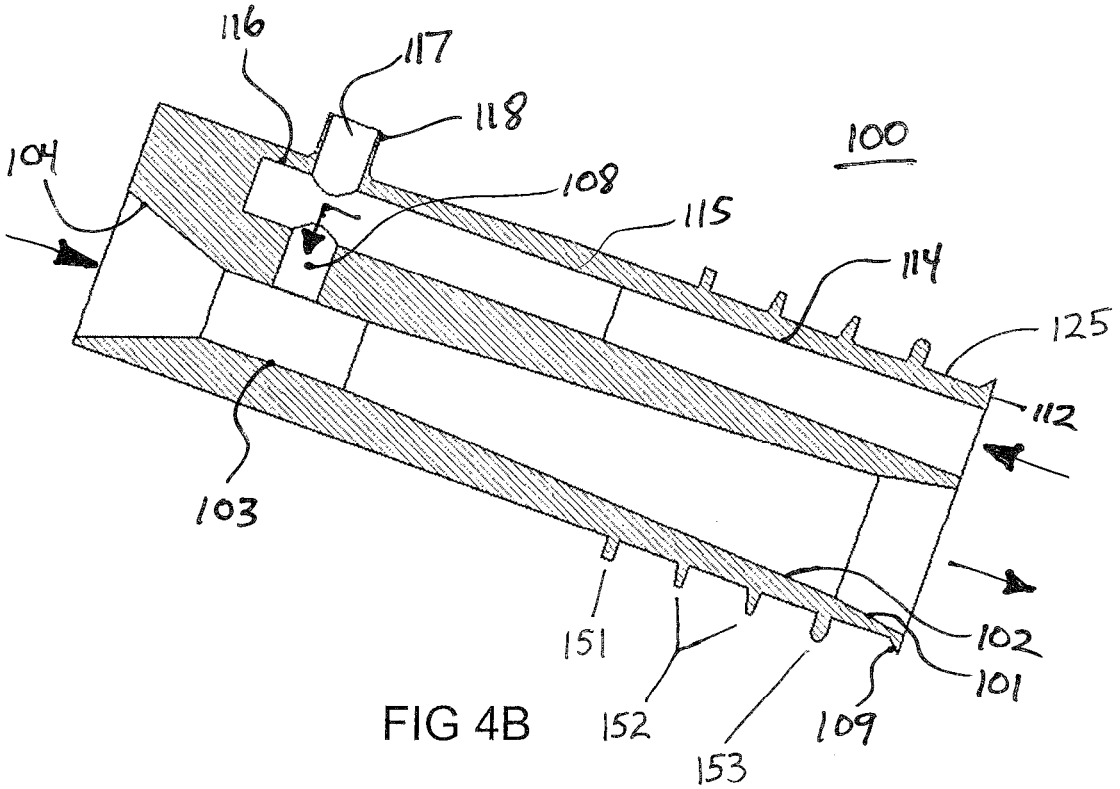
FIG. 4B is a section view of the preferred embodiment

Referring to FIG. 4A. In the preferred embodiment, spout taper 101 serves as a visual clue for a person pouring wine. The straight 130 on spout circumference 111 is also a visual cue for the pourer to hold this straight 130 horizontal and higher than the round region of circumference 111. This action orients aerator 100 relative to gravitational force, which allows the wine to be dispensed with the best aeration performance. One skilled in the art would realize that straight 130 could also be curved up or down without changing its purpose. Also in some embodiments spout 101 and spout circumference 111 are not included. In this embodiment the venturi exhaust 102 would terminate at the exterior face 112. Section line D-D is the defining cross-section cut for FIG. 4B Referring to FIG. 4B when the bottle 135 is tipped for pouring, in the preferred embodiment, the wine flows from venturi intake 104 through venturi throat 103 (where air is added from venturi air intake 108) and out of venturi exhaust 102. The flow rate is the same throughout this passage; therefore the fluid is forced to speed up as it passes through venturi throat 103. This increase in speed causes a pressure decrease relative to atmospheric air pressure. Air at venturi air intake 108, which is at atmospheric pressure, is then pulled into the lower pressure fluid stream in venturi throat 103. This action causes air to be intermixed with the wine and therefore aerate it. The air at the venturi air intake 108 originates at exterior face 112 and travels through taper passage 114, then through air passage 115, and finally through venturi air intake 108. In some embodiments one skilled in the art would know that taper passage 114 could be straight.

Figure 5A:
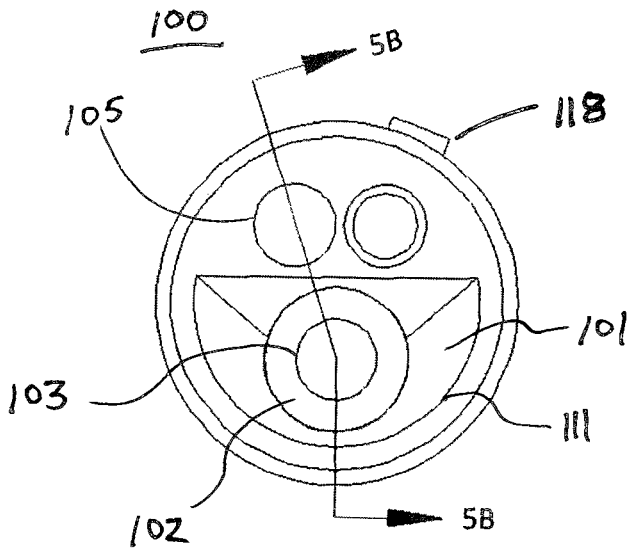
FIG. 5A is a front view of the preferred embodiment
Figure 5B:
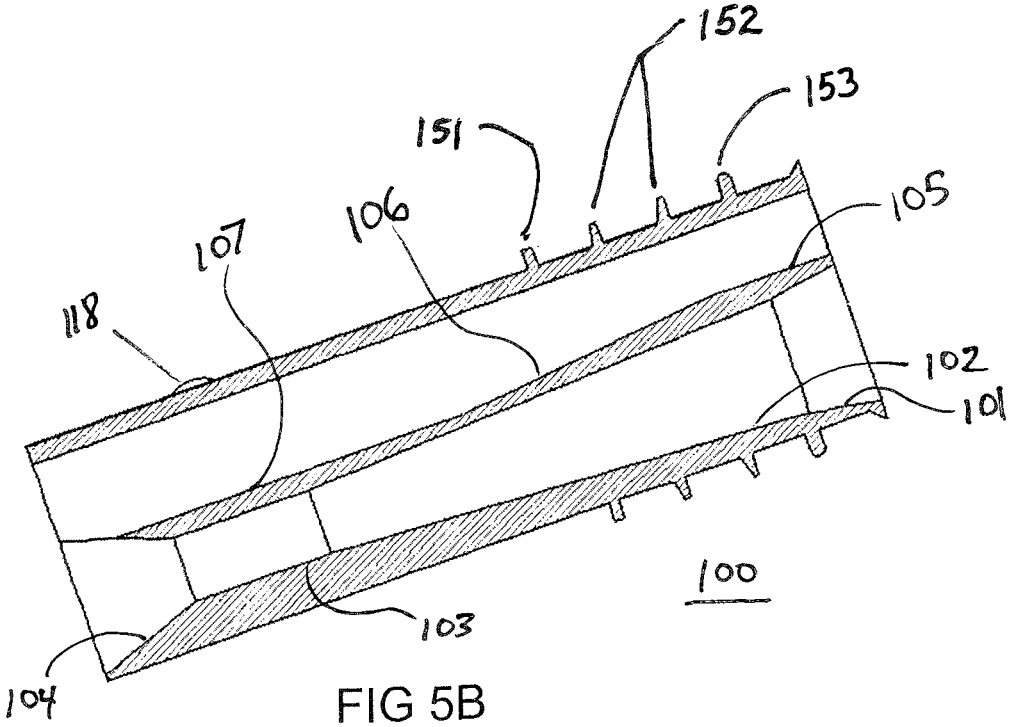
FIG. 5B is a section view of the preferred embodiment

Referring to FIG. 5A Aerator 100 is shown when viewed normal to neck face 131. Section line E-E is the defining cross-section cut for FIG. 5B Referring to FIG. 5B cross section of Aerator 100 through section line illustrated tin FIG. 5A is shown. In this figure Aerator 100 is tipped up.

Referring to FIGS. 4A, 4B, 5A, and 5B, 6, 7, and 8 for the preferred embodiment, the Aerator 100 would be made in the most economic manner possible. Injection molding is the preferred manufacturing process. Injection molding requires core pins to create passages for example venturi air intake 104, venturi throat 103, venturi exhaust 102, spout taper 101, taper 114, air passage 115, and venturi air intake 108. In order to create venturi air intake 108 (which is normal or close to normal to venturi throat 103) a core pin (not shown) would also create air intake seal 118 in the cylindrical face 125 of the aerator 100. This opening 117, if not blocked in some manner, would allow wine to flow into the venturi air intake 108, which would reduce or stop the airflow into the venturi throat 103, reducing or eliminating the aeration performance. To eliminate this undesired intrusion of wine, the preferred embodiment includes an air intake seal 118 which is created in the injection mold. As aerator 100 is inserted into the bottle 135, air intake seal 118 is allowed to distort in a manner to create a seal with the inner neck taper 132 of the bottle 135. This can be seen in FIG. 7. One skilled in the art would realize that this distortion could result in air intake seal folding over due to bending stress or collapsing on itself like a bellows due to compressive stress or a combination of these two stresses.

One skilled in the art would also realize that in some embodiments a tapered plug 138 (not shown) could be pressed into opening 117 to seal it off.

Figure 8:
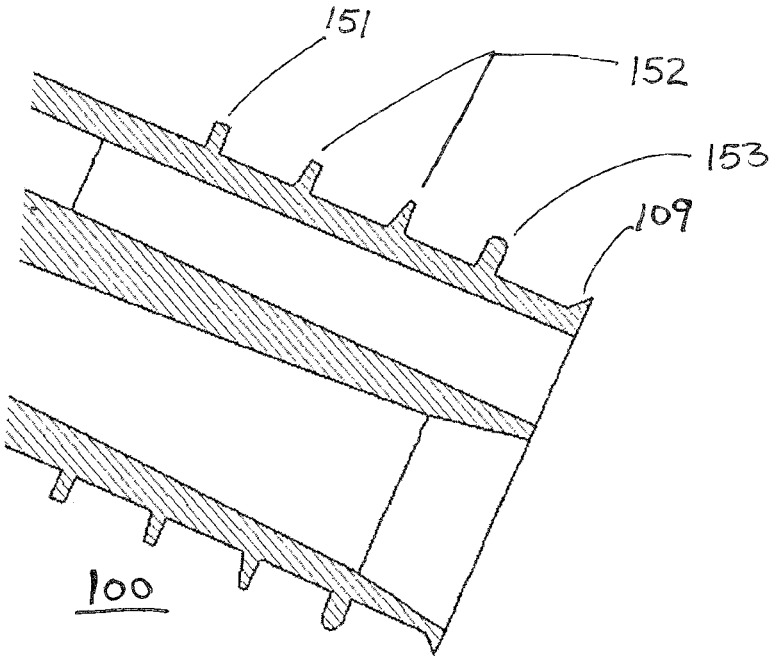
FIG. 8 is a section view of the preferred embodiment

Referring to FIG. 8. A lip 109 in the preferred embodiment serves to seat the aerator 100 to the bottle chamfer 136 (not shown) which most manufacturers incorporated into their wine bottle 135. Square rib 151, tapered rib 152, and rounded rib 153 are also shown. A quantity of four (approximately equally spaced) Of Tapered rib 152 is the preferred embodiment and one skilled in the art would realize that any number of the tapered rib 152, square rib 151, or rounded rib 153 in any combination or spacing could be utilized within the area on the cylindrical face 125 to provide a seal between aerator 100 and neck face 131 (not shown). Due to the large diameter variation of commercially available bottle 135; square rib 151, tapered rib 152, and rounded rib 153 have more height and yet more ability to bend over and seal than for example a half torus (half round) protruding from cylindrical face 125. For example a half round protruding from cylindrical face 125 would be too stiff to deflect when installed in the smallest diameter bottle, and would also be too short to seal against the neck face 131 (not shown) of a bottle with nearly the largest neck diameter manufactured.

Figure 6:
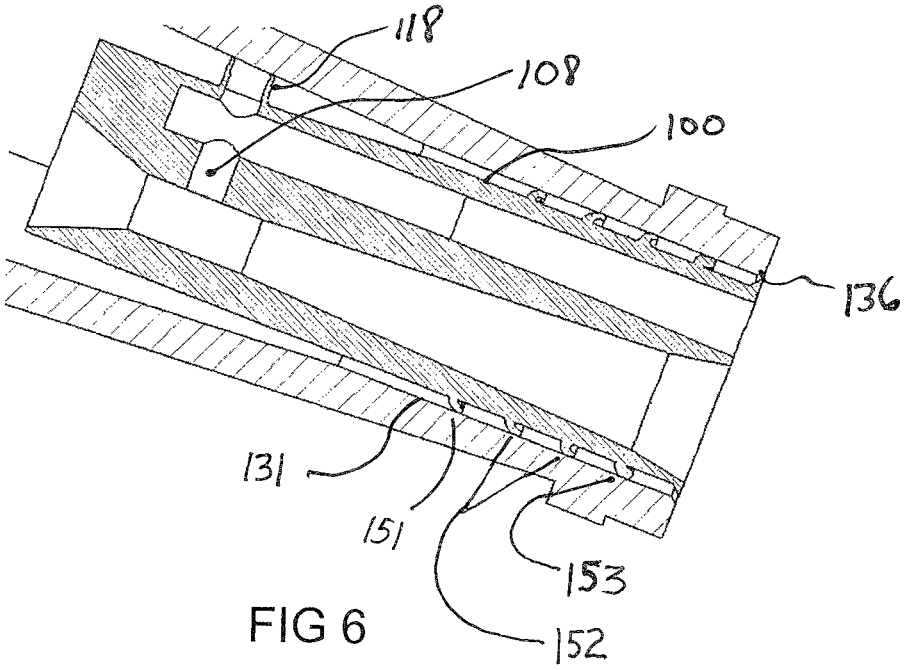
FIG. 6 is a section view of the preferred embodiment
Figure 7:
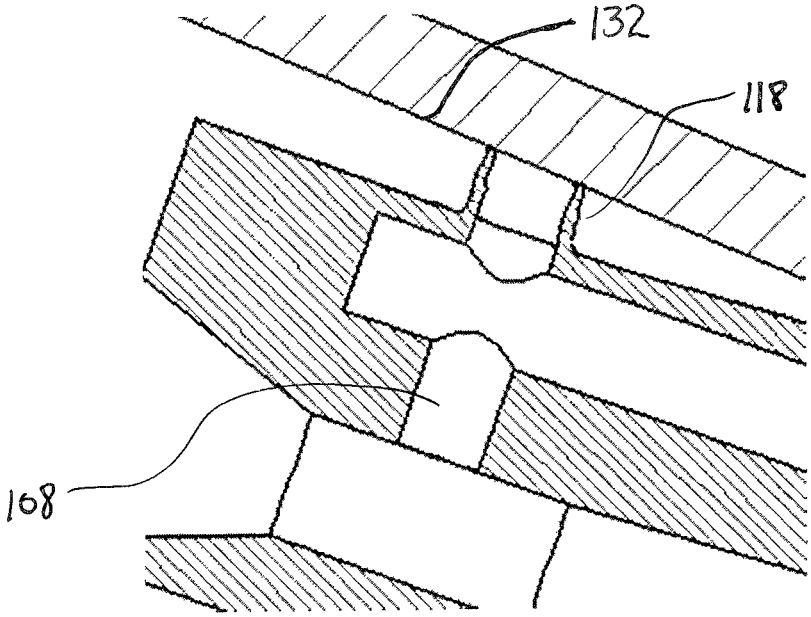
FIG. 7 is a section view of the preferred embodiment
Figure 9:
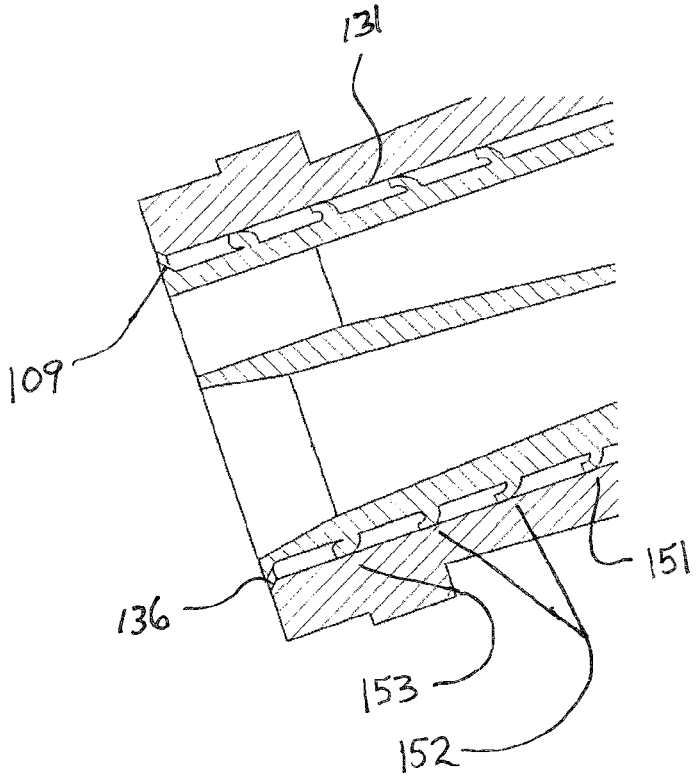
FIG. 9 is a section view of the preferred embodiment

Referring to FIG. 6. Aerator 100 is shown installed in bottle 135. FIG. 6 is an example of the distortion that Aerator 100 experiences after insertion into bottle 135. It is a view of the venturi air intake and associated flow paths Referring to FIG. 9. This is a cross-section and illustrates an example of the distortion the square rib 151, or rounded rib 153, or preferred embodiment tapered rib 152 would experience when aerator 100 is pressed into the neck face 131 of a wine bottle 135. The interaction between lip 109 and bottle chamfer 136 are also shown. In the preferred embodiment the lip prevents aerator from being driven too deep into aerator 100. In the preferred embodiment a small gap between lip 109 and bottle chamfer 136 is acceptable.

Figure 10:
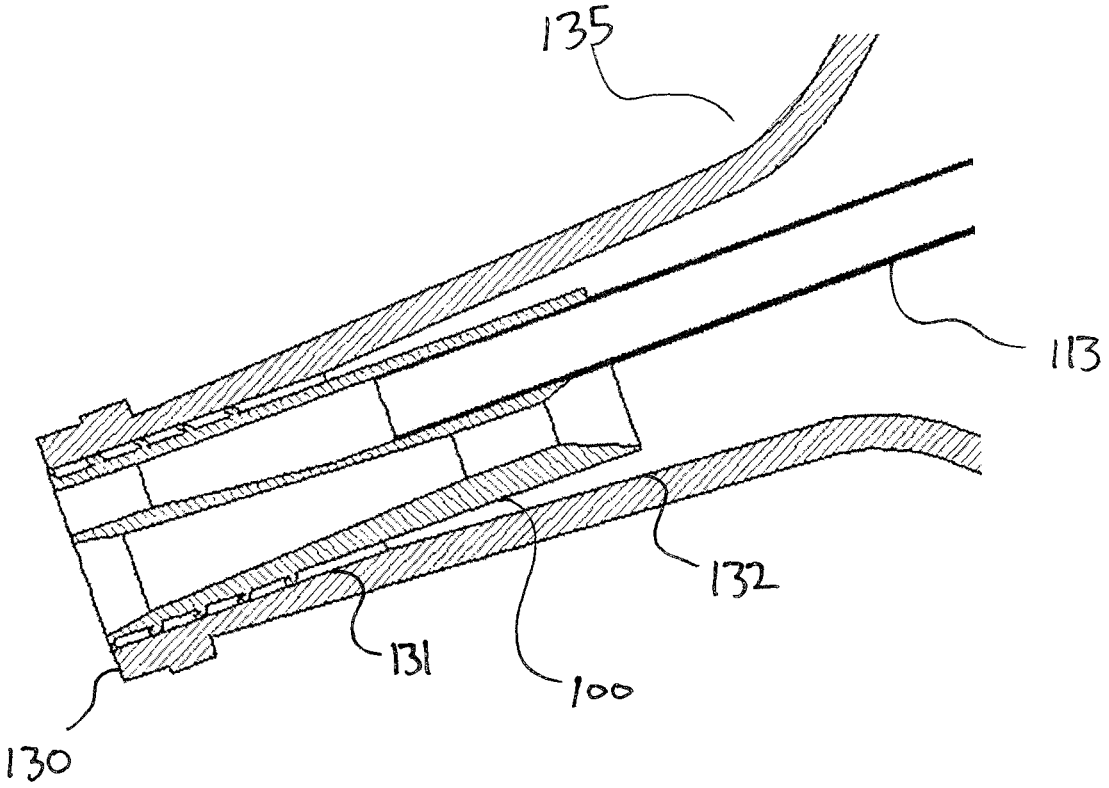
FIG. 10 is a closeup view of FIG. 3B of the preferred embodiment

Referring to FIG. 10. An example of an installed Aerator 100 is shown installed in bottle 135. It also shows the position of the bottle vent tube in the preferred embodiment.

For the preferred embodiment the venturi air intake 108 diameter is in the range of 0.130-0.150 inches. The venturi throat 103 is 0.205 to 0.225 inches in diameter. The included angle for the venturi intake 104 is 30 to 50 degrees. The included angle for the venturi exhaust 102 is 5.0 to 7.0 degrees. The air passage 115 diameter is 0.150 to 0.170 inches. The diameter of the bottle vent intake 105 is 0.180 to 0.200 inches. The diameter of surface 107 is approximately 0.280 inches to accommodate a slightly larger bottle vent tube 113 to create a press fit. The diameter of the cylindrical face 125 0.68 to 0.70 inches the inside diameter of bottle vent tube is 0.240 to 0.265 inches.

For some embodiments the venturi air intake 108 diameter is in the range of 0.110-0.160 inches. The venturi throat 103 is 0.200 to 0.250 inches in diameter. The included angle for the venturi intake 104 is 40 to 80 degrees. The included angle for the venturi exhaust 102 is 4.0 to 8.0 degrees. The air passage 115 diameter is 0.140 to 0.180 inches. The diameter of the bottle vent intake 105 is 0.160 to 0.200 inches. The diameter of surface 107 is approximately 0.190 to 0.280 inches to accommodate a slightly larger bottle vent tube 113 to create a press fit. The diameter of the cylindrical face 125 is 0.66 to 0.69 inches the inside diameter of bottle vent tube is 0.190 to 0.260 inches.

Figure 11:
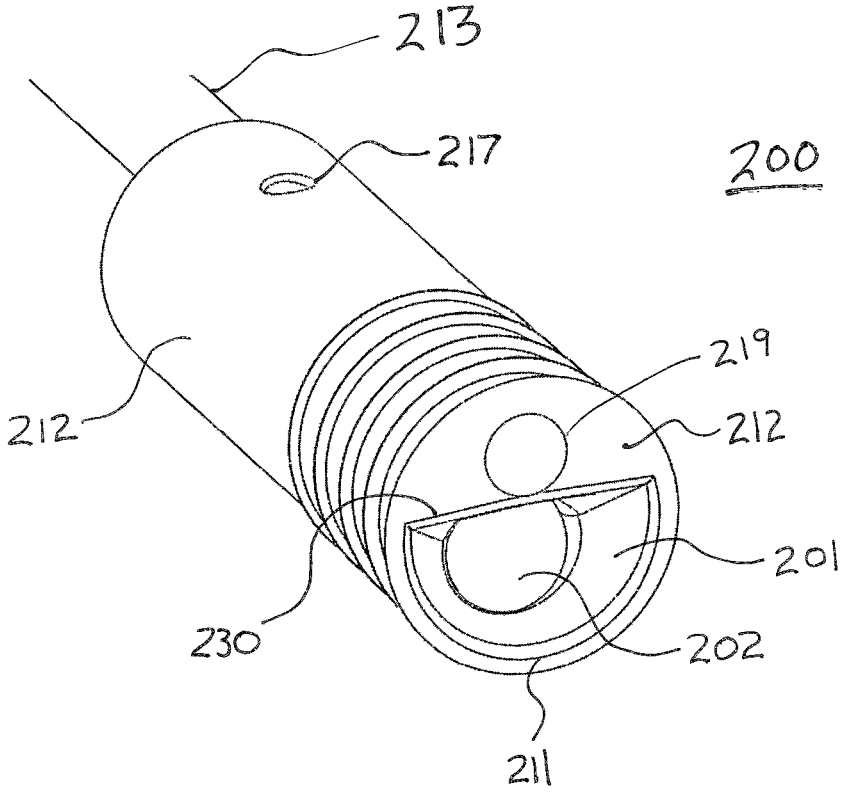
FIG. 11 is an isometric front oriented view of another embodiment

Referring to FIG. 11 Aerator 200, which is not the preferred embodiment, is used to aerate wine, is shown with exterior face 212 and cylindrical face 225. The aerator 200 has a cylindrical face 225 which is small enough in diameter to fit into the neck of a wine bottle. During operation air is sucked into air intake port 219. At the same time aerated wine flows out of venturi exhaust 202. In order for this to process to function correctly opening 217 (which is a byproduct of the injection molding process) would be sealed. In the some embodiments aerator 200 is molded out of PE plastic, but one skilled in the art would realize that Aerator 200 could be made from other plastics such as but not limited to PET, PCP, HDPE, LDPE, PP, PVC, PEEK, PFA, POM, FEP, PPS, FEP in some embodiments Aerator 200 could also be machined or cast from materials such as aluminum or stainless steel or plastic such as PET, PE, PCP, HDPE, LDPE, PP, PVC, PEEK, PFA, POM, FEP, PPS, FEP. Aerator 200 could also be made from ceramic, glass, or an elastomer.

Still referring to FIG. 11. In some embodiments, spout taper 201 serves as a visual clue for a person pouring wine. The straight 230 on spout circumference 211 is also a visual cue for the pourer to hold this straight 230 horizontal and higher than the round region of circumference 211. This action orients aerator 200 relative to gravitational force, which allows the wine to be dispensed with the best aeration performance. One skilled in the art would realize that straight 230 could also be curved up or down or any other shape without changing its purpose. Also in some embodiments spout 201 and spout circumference 211 are not included. In this embodiment the venturi exhaust 202 would terminate at the exterior face 212.

Figure 12:
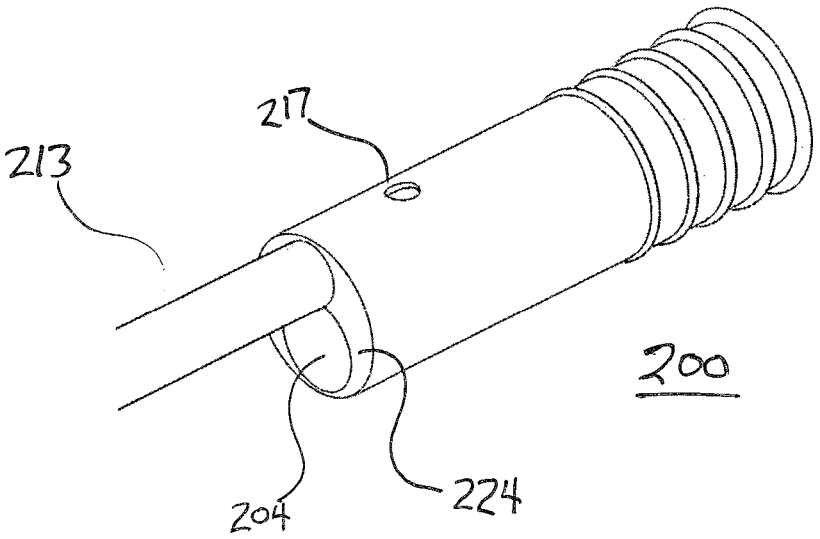
FIG. 12 is an isometric rear oriented view of another embodiment

Referring to FIG. 12 the rear of an embodiment Aerator 200 is shown, rear face 224 has chamfered vent tube 213 inserted into it and is held into the aerator with friction, although a person skilled in the art would realize that chamfered vent tube 213 could be fixed to aerator 200 with adhesive or welded or heat staked or an integral part and produced during injection molding of aerator 200 during manufacturing. In this embodiment chamfered vent tube 213 is co-linear with and an open airway with air intake port 219 (not shown). Also in this embodiment chamfered vent tube 213 is extruded out of PE plastic, but one skilled in the art would realize that it could also be made from PET, PCP, HDPE, LDPE, PP, PVC, PEEK, PFA, POM, FEP, PPS, FEP. In some embodiments it could also be molded or drawn or made from SS, copper alloy, or nickel alloy tubing. Venturi intake 204 is also shown in FIG. 12; in operation wine would flow into Venturi intake 204, then through venturi throat 203, then out of aerator 200 on the far side of aerator 200 as shown in FIG. 12.

Figure 13:
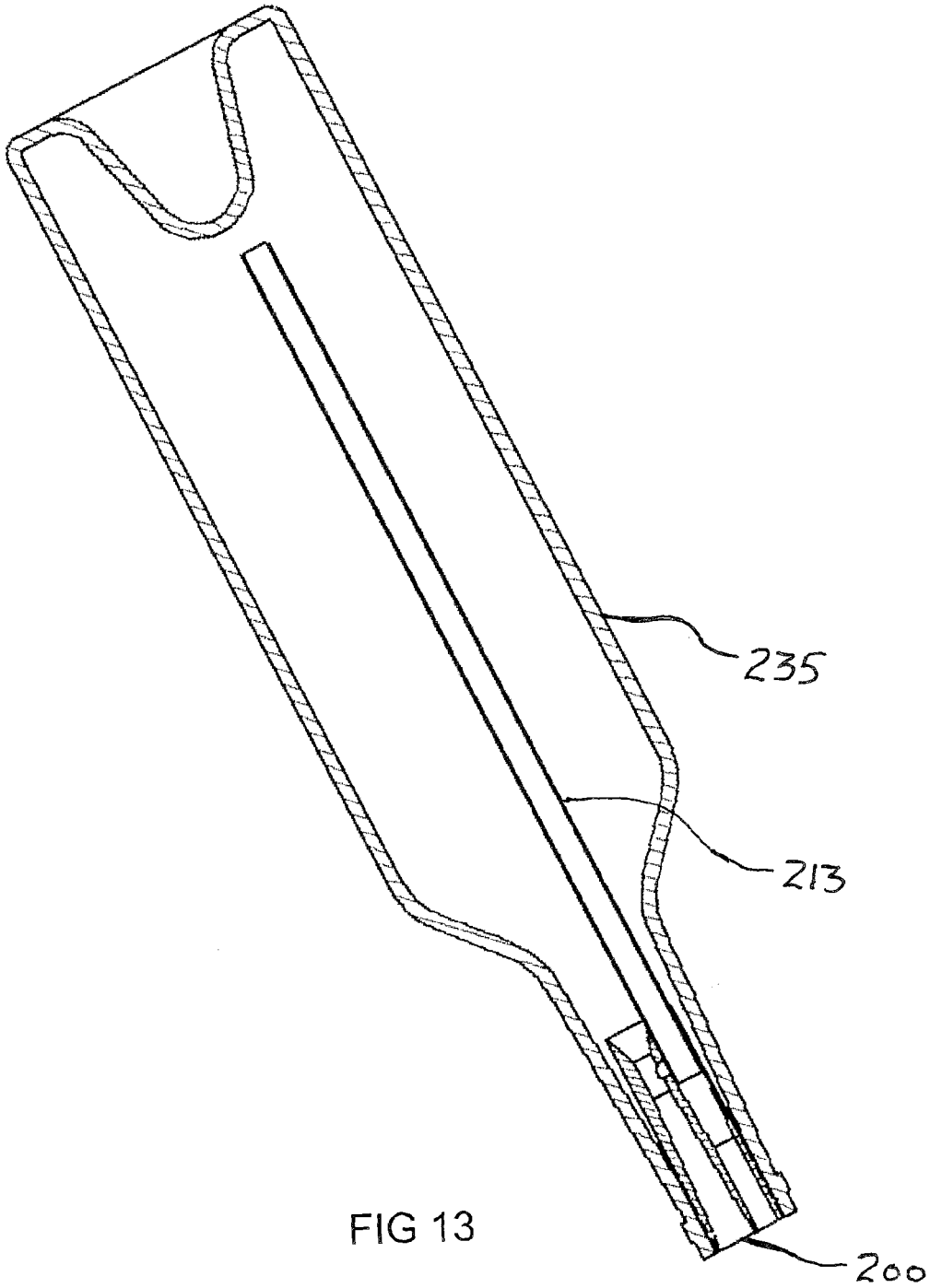
FIG. 13 is a section view of another embodiment

Referring to FIG. 13 a cross section of aerator 200 is shown. Aerator 200 is not the preferred embodiment. It is comprised of chamfered vent tube 213 which is used to allow air flow to the bottle bottom 233 and also serves to plug opening 217 which is created during manufacturing, specifically injection molding.

Figure 14A:
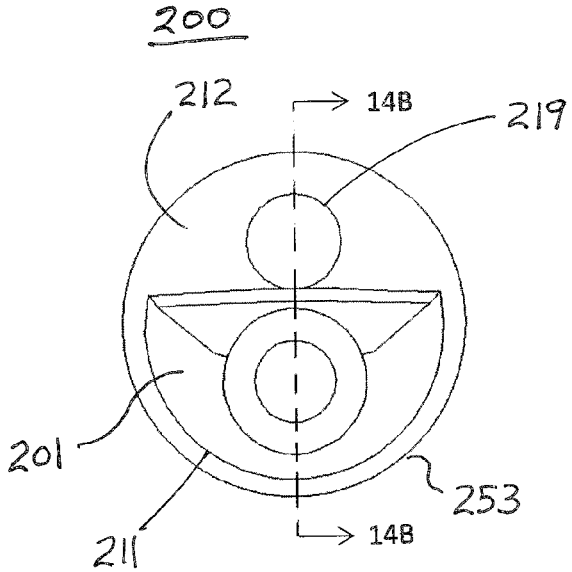
FIG. 14A is a front view of another embodiment

Referring to FIG. 14A a view of aerator 200 normal to neck face 231 is shown. The section line the reference for FIG. 14B.

Figure 14B:
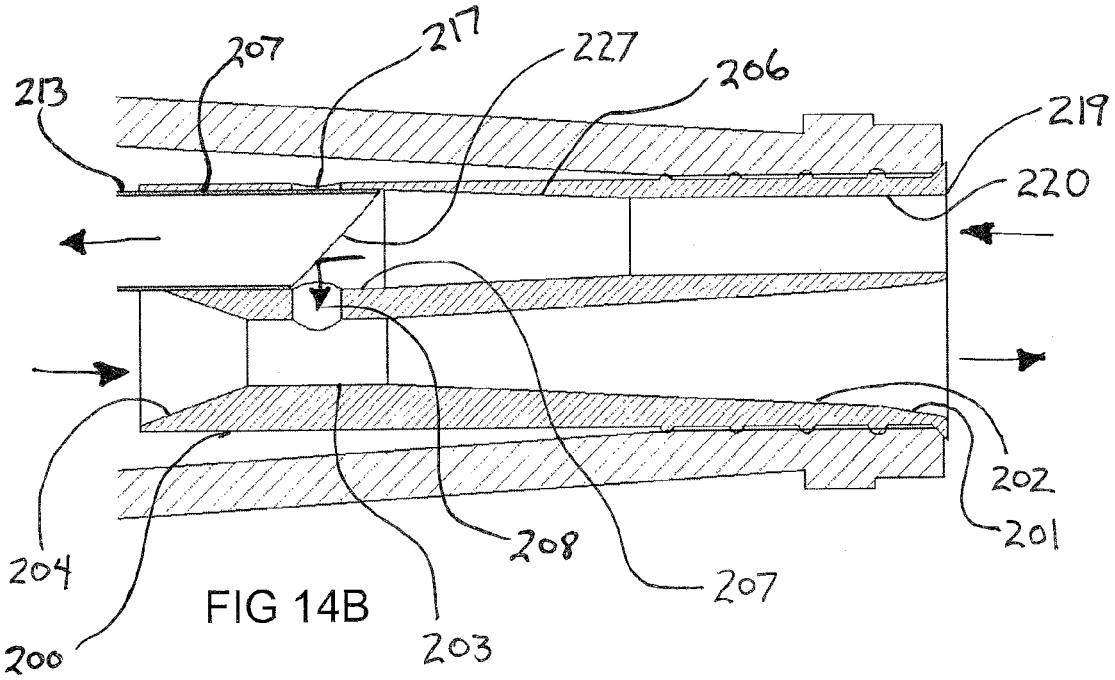
FIG. 14B is a section view of another embodiment

Referring now to FIG. 14B, which is a section view oriented from the section line shown in FIG. 14A. In some embodiments tube chamfer 227 is shown relative to aerator 200. The longer portion of chamfered vent tube 213 would be oriented to plug opening 217 and the shorter side of chamfered vent tube 213 would then allow air to flow into venturi throat 203 from air intake port 219. Air is then also allowed to flow through chamfered vent tube 213 to the bottle bottom 233 (not shown). At the same time wine flows from inside the bottle 235 through venturi intake 204 then through venturi throat 203, where air is introduced, then out through venturi exhaust 202. Tapered surface 206 incrementally creates higher pressures onto tube 213 to secure it as it is inserted deeper into aerator 200. Or in some embodiments surface 207 is a tight fit with tube 213 and friction holds the tube in place.

Figure 14C:
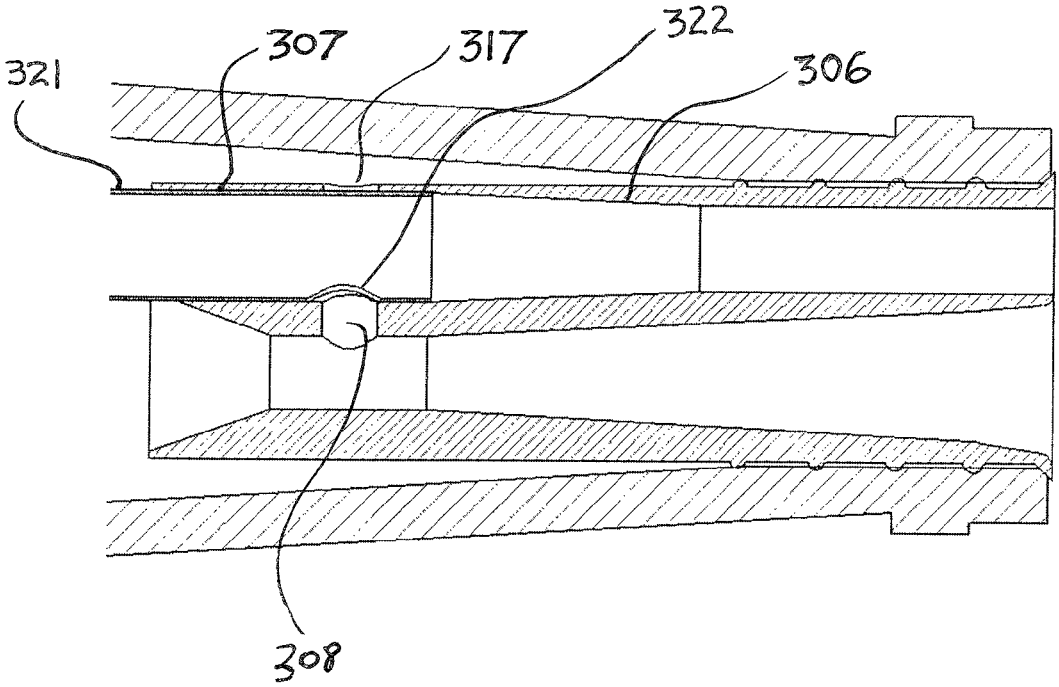
FIG. 14C is a section view of another embodiment

Referring to FIG. 14C in some embodiments, opened vent tube 321 has a tube opening 322 in it, which could be an opening of any shape or a slot open to the end of opened vent tube 321. This would allow for a practically square cut tube on both ends to be utilized. Tube opening 322 is oriented so that it is concentric or partially concentric to venturi air intake 308. This results in plugging opening 317 yet allowing air to flow into venturi air intake 308. Air would also flow down the length of opened vent tube 321 to the bottle bottom 233.

Figure 15:
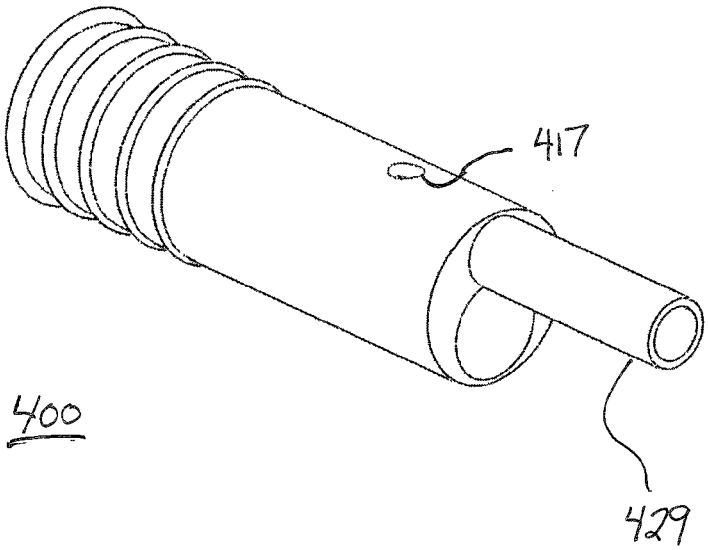
FIG. 15 section view of another embodiment

Referring to FIG. 15 in some embodiments, Instead of tube being installed into the aerator 400, a tube boss 429 could be integrated into the aerator 400. Tube boss 429 would be injection molded and integral to aerator 400. In some embodiments in order to secure bottle vent tube 413 (not shown), it would be press fit onto the outside of tube boss 429. Also in some embodiments it could be press-fit into the inside of tube boss 429. Bottle vent tube 413 (not shown) would then protrude to nearly the bottle bottom 433 (not shown). In some embodiments, the length of bottle vent tube 413 is restricted by the depth of the bottle 435 (not shown). In this embodiment there should be a slight gap between the bottle vent tube 413 and the bottle bottom 433 (not shown). This gap allows for flow of air and keeps the bottle bottom 433 (not shown) from occluding the tube. A person skilled in the art will realize that the bottle vent tube 413 could be shorter. In some embodiments the diameter of the vent tube 413 is the same as a large drinking straw, although in some embodiments the diameter could be smaller or larger.

In some embodiments, it would be obvious to those skilled in the art that multiples or any combinations of any of the following could be utilized in any embodiment; bottle vent tube 113, or chamfered vent tube 213, or opened vent tube 321, or venturi air intake 108, or venturi air intake 208.

For some embodiments the air intake port 219 diameter is in the range of 0.210-0.230 inches. The venturi throat 203 is 0.205 to 0.225 inches in diameter. The included angle for the venturi intake 204 is 30 to 50 degrees. The included angle for the venturi exhaust 102 is 5.0 to 7.0 degrees. The diameter of surface 207 is approximately 0.280 inches to accommodate a slightly larger chamfer vent tube 213 or opened vent tube 321 to create a press fit. The diameter of the cylindrical face 225 0.68 to 0.70 inches the inside diameter of bottle vent tube is 0.240 to 0.260 inches, although manufacturing processes in some embodiments may change this range.

For other embodiments the air intake port 219 diameter is in the range of 0.190-0.250 inches. The venturi throat 203 is 0.210 to 0.260 inches in diameter. The included angle for the venturi intake 204 is 40 to 80 degrees. The included angle for the venturi exhaust 202 is 4.0 to 8.0 degrees. The diameter of surface 207 is approximately 0.190 inches to 0.280 accommodate a slightly larger chamfer vent tube 213 or opened vent tube 321 to create a press fit. The diameter of the cylindrical face 225 is 0.66 to 0.69 inches The inside diameter of chamfer vent tube 213 or opened vent tube 321 is 0.190 to 0.260 inches, although manufacturing processes in some embodiments may change this range In some embodiments the diameter of tube boss 429 is 0.190-0.280 to accommodate a press fit of bottle vent tube 413 with a slightly smaller inside diameter.

Testing using a Dwyer flow meter temporarily attached to the venturi air intake port 119 revealed poor results with a bottle vent tube 113 in preferred embodiment (or bottle vent tube 213 in other embodiments) that was less than one inch long. When a longer bottle vent tube 113 was attached to the aerator 100 (preferred embodiment) or aerator 200 the relative position of the ball in the flow meter raised indicating better suction and therefore an increase of air flow into the venturi throat 103 in the preferable embodiment (or venturi throat 203 in other embodiments). This revealed that the flow rates were improved and in turn an increase in the air quantity pulled into the wine at the venturi throat 103. In the preferred embodiment, when extrapolating the experimental evidence, the bottle vent tube 113 provides the best performance when it is as long as possible. Due to results of this testing, one skilled in the art would realize that if bottle vent tube 413 is too short performance could suffer. Also, one skilled in the art would realize that due to variation in bottle 135 depths, it may not be practical to custom fit bottle vent tube 113 for each bottle manufacturer. Also in the preferred embodiment the bottle vent tube 113 cannot be so long that it retards air flow through the tube due to contact with the bottle bottom 233. Test results using a bottle with the bottom cut off also revealed that keeping atmospheric pressure at the back of the bottle increases flow through the preferred aerator 100 and in some other embodiments using aerator 200.

A person skilled in the art would realize that the venturi and the air supply for the venturi could be eliminated with the bottle vent features retained. This device could then be used to dispense any liquid very rapidly at a constant rate. For example; starting with aerator 100, venturi throat 103 could be increased in diameter to the point of eliminating or almost eliminating spout taper 101, venturi exhaust 102 and venturi intake 104. This would result in a larger more constant diameter bore through aerator 100. This would then be a larger cross-sectional flow path for fluid flowing out of the bottle. The air supplied the venturi to provide aeration would also be eliminated. This would include taper 114, air passage 115, and venturi air intake 108. In this example, bottle vent tube 113 and its air path in aerator 100 would be retained; this would include bottle vent intake 105, tapered surface 106 and surface 107. Also one skilled in the art would realize that in this example the new bore created for dispensing fluid would not need to be round in cross-section shape. For example, It could be oval, or an oval that wraps around the centerline of the bottle vent tube 113, or any other shape.

While the present invention has been shown and described in various embodiments, those skilled in the art will appreciate from the drawings and the foregoing discussion that various changes, modifications, and variations may be made without departing from the spirit and scope of the invention as set forth in the claims. Hence the embodiments shown and described in the drawings and the above discussion are merely illustrative and do not limit the scope of the invention as defined in the claims herein. The embodiments and specific forms, materials, and the like are merely illustrative and do not limit the scope of the invention or the claims herein.

What is claimed is:

1. An aeration device for use substantially within the neck of a fluid vessel, which is used for simultaneously egressing liquid from a vessel and mixing air into the liquid comprising:

an aerator having venturi for reducing the pressure of egressing liquid thereby enabling ingress of higher pressure atmospheric air into said liquid, and at least one vent tube connected to said aerator establishing fluid communication between atmosphere exterior of said vessel and upper interior region of said vessel to enable ingress of atmospheric pressure air when said vessel is in a dispensing orientation, and at least one air passage in said aerator establishing fluid communication between said venturi and atmosphere exterior of said vessel.

2. The aerator of claim 1 wherein a tubular boss is created in said aerator during manufacture that said vent tube slips over.

3. The aerator of claim 1 wherein an opening is created during manufacture that is somewhat collinear with an air intake for said venturi and normal to and intersects an outer surface of said aerator.

4. The aerator of claim 1 wherein a spout at the terminus of said venturi, or said venturi, are radially offset from the centerline of said aerator.

5. The aerator of claim 3 wherein a seal is connected to said aerator and is somewhat coincident to said air intake such that said opening is plugged when said seal is in contact with an inner face of said vessel.

6. The aerator of claim 3 wherein said opening in said outer face is plugged with a plug.

7. An aeration device for use substantially within the neck of a fluid vessel, which is used for simultaneously egressing liquid from a vessel and mixing air into the liquid comprising:

an aerator having a venturi for reducing the pressure of egressing liquid thereby enabling ingress of higher pressure atmospheric air into said liquid, and at least one vent tube connected to said aerator establishing fluid communication between atmosphere exterior of said vessel and upper interior region of said vessel, to enable ingress of atmospheric pressure air when said vessel is in a dispensing orientation, and at least one air passage in said aerator establishing fluid communication between both said venturi and said vent tube as well as atmosphere exterior of said vessel.

8. The aerator of claim 7 wherein an opening is created during manufacture that is somewhat collinear with an air intake for said venturi and normal to and intersects an outer surface of said aerator.

9. The aerator of claim 8 wherein said vent tube plugs said opening in the outer face of said aerator.

10. The vent tube of claim 9 wherein said vent tube has a chamfered end that is oriented so that the non chamfered region of said chamfered end plugs said opening in the outer face of said aerator and the chamfered region is oriented adjacent to said air intake to enable air flow into said venturi.

11. The vent tube of claim 9 wherein said vent tube has an opening near its end that is oriented to be somewhat concentric to said air intake to enable air flow.

12. The vent tube of claim 7 wherein said vent tube is integrated into said aerator during manufacturing.

13. The aerator of claim 7 wherein a tubular boss is created in said aerator during manufacture that said vent tube slips over.

14. The aerator of claim 8 wherein said opening in the outer face is plugged due to contact between a seal connected to said aerator and an inner face of said vessel.

15. The aerator of claim 8 wherein a seal is connected to said aerator and is somewhat coincident to said air intake such that said opening is plugged when said seal is in contact with an inner face of said vessel.

16. The aerator of claim 8 wherein said opening in said outer face of said aerator is plugged with a plug.

17. The aerator of claim 7 wherein a spout at the terminus of said venturi or said venturi are radially offset from the centerline of said aerator.

18. The aerator of claim 1 wherein said aerator is used in a vessel with a twist top.

19. The aerator of claim 7 wherein said aerator is used in a vessel with a twist top.

* * * * *